US006120213A

United States Patent [19]

Stinton

[11] Patent Number: 6,120,213

[45] Date of Patent: Sep. 19, 2000

[54] MODULAR DIVER'S BUOYANCY CONTROL DEVICE

[75] Inventor: Robert T. Stinton, Lakeside, Calif.

[73] Assignee: Diving Unlimited International, Inc., San Diego, Calif.

[21] Appl. No.: 08/961,719

[22] Filed: Oct. 31, 1997

[51] Int. Cl.[7] ..... B63C 11/02

[52] U.S. Cl. ..... 405/186; 441/111

[58] Field of Search ..... 405/186; 441/106, 441/108, 111, 112, 113, 114

[56] References Cited

U.S. PATENT DOCUMENTS

| | | | |
|---|---|---|---|
| 4,660,751 | 4/1987 | von Dewitz | 3/8 |
| 4,990,115 | 2/1991 | Vorhauer et al. | 441/111 |
| 5,020,941 | 6/1991 | Bulin et al. | 405/186 |
| 5,205,672 | 4/1993 | Stinton | 405/186 |
| 5,249,890 | 10/1993 | Bergstrom | 405/186 |
| 5,346,419 | 9/1994 | Kaiser | 441/111 |
| 5,451,121 | 9/1995 | Seligman | 405/186 |
| 5,562,513 | 10/1996 | Kaiser | 405/186 |
| 5,607,258 | 3/1997 | Eungard | 441/106 |
| 5,620,282 | 4/1997 | Stinton | 405/186 |

*Primary Examiner*—Eileen Dunn Lillis
*Assistant Examiner*—Frederick L. Lagman
*Attorney, Agent, or Firm*—Michael H. Jester

[57] ABSTRACT

A diver's buoyancy control device (BCD) comprises a jacket configured to be worn by a diver. The jacket includes a back portion for overlying a diver's back and a pair of side portions connected to the back portion for overlying the diver's chest. A scuba tank can be releasably connected to the back portion of the jacket. An inflatable bladder is connected to the back portion of the jacket and a mechanism is provided for selectively inflating and deflating the bladder with a pressurized gas from the scuba tank. The base of a shoulder yoke that includes a pair of shoulder straps is adjustably connected to the back portion of the jacket at a plurality of preselected vertical positions for permitting easy and rapid size adjustment. A waist belt has a pair of segments each of which has a rear end that is attached to a corresponding location on a corresponding side of the back portion of the jacket. A first mechanism is provided for releasably coupling a pair of mating forward ends of the waist belt segments. A pair of shoulder strap extensions are provided, each of which has a lower end connected to a corresponding waist belt segment. A second mechanism is provided for releasably coupling an upper end of each shoulder strap extension to a corresponding shoulder strap of the shoulder yoke. The waist belt is provided with a quick release weight system to enable emergency ascent. The bladder may have extra buoyancy cells connected to an outer wing of each side portion of the jacket for increased surface flotation capability. Stay straps connected to the waist belt may connect to the wings to counter their buoyant force.

21 Claims, 8 Drawing Sheets

MODULAR DIVER'S BUOYANCY CONTROL DEVICE

BACKGROUND OF THE INVENTION

The present invention relates to apparatus used by scuba diver's, and in particular, to an improved device in which an inflatable bladder is used to adjust a diver's buoyancy.

Buoyancy control devices have long been used by diver's to regulate their buoyancy during the course of a dive. Often a diver needs to have neutral buoyancy so that the diver may easily control his or her movement underwater simply by walking or swimming. Alternatively, a diver may want to dive "heavy" if there is substantial current in order to stay on or near the bottom. Conversely, a diver may desire positive buoyancy in order to float on the surface upon conclusion of a dive.

The earliest known example of a diver's buoyancy control device is disclosed in U.S. Pat. No. 40,114 granted to T. C. McKeen in 1863, during the American Civil War. That device was designed to be worn on a diver's back and included an inflatable bladder.

The advent of scuba diving during World War II led to the development of more sophisticated devices for regulating a diver's buoyancy. Both wet and dry suits used by scuba divers add substantial positive buoyancy which can be counteracted by a weight belt. However, the need for precise buoyancy regulation during scuba diving results from changes in a diver's weight and water displacement over time and at different depths. The diver's weight and water displacement will change as a result of compression or expansion of trapped gas in the cells of the diver's wet suit or dry suit as the depth of the dive increases or decreases. In addition during an average scuba dive the diver loses approximately six pounds in weight because compressed breathable gas is consumed by the diver from his or her scuba tank. In addition to compensating for changes in buoyancy due to changes in the diver's weight and water displacement, the diver may also want to change his or her buoyancy to dive heavy or float, as previously described.

Modern diver's buoyancy control devices typically comprise an inflatable bladder worn on the diver's back and a manual control actuated by the diver to add gas to the bladder from the scuba tank or to vent gas from the bladder into the water. Typically the manual control is associated with a hose that connects to a fitting on the diver's regulator and to the bladder. For example, in my U.S. Pat. No. 5,620,282 entitled BUOYANCY COMPENSATOR ASSEMBLY granted Apr. 15, 1997 there is disclosed a diver's buoyancy control device with a special passageway for guiding hoses that extend between the scuba tank regulator, the manual control and the bladder. This configuration reduces the possibility of entanglement of the hoses which can lead to a diving accident.

Diver's buoyancy control devices are fairly complex and expensive items which must function correctly to enable a comfortable free dive, but which also must function correctly to avoid a serious accident. Presently they must be manufactured in a variety of sizes for small, medium and large stature men and women. In addition, buoyancy control devices must presently be tailored to either provide neutral buoyancy during a dive, or to have the additional capability of providing substantial surface flotation. They must also be configured to be worn with and without a weight belt. The weight belt must not only be separately donned, but in addition, must be accessible for emergency release. It would be desirable to provide an improved diver's buoyancy control device which could be adjusted to fit a larger range of diver sizes, while at the same time being configured to more easily cooperate with a weight belt and provide the option for substantial surface flotation.

SUMMARY OF THE INVENTION

It is therefore the object of the present invention to provide an improved diver's buoyancy control device.

It is another object of the present invention to provide a modular diver's buoyancy control device which can be used in a variety of configurations.

It is still a further object of the present invention to provide a diver's buoyancy control device that can be easily adjusted in size to fit a wider range of diver's statures.

In accordance with the present invention a diver's buoyancy control device (BCD) comprises a jacket configured to be worn by a diver and a mechanism for releasably connecting a scuba tank to a back portion of the jacket. An inflatable bladder is connected to the back portion of the jacket. A control mechanism is provided for selectively inflating and deflating the bladder with a pressurized gas from the scuba tank. A pair of shoulder straps are provided. The rearward ends of the shoulder straps are adjustably connectable to the back portion of the jacket at a plurality of preselected vertical positions to vary the size of the BCD to accommodate different diver statures. A waist belt is provided that includes a pair of segments. Each waist belt segment has a rear end attached to a corresponding location on the back portion of the jacket. A connecting mechanism is provided for releasably coupling a pair of mating forward ends of the waist belt segments. Additional connecting mechanisms and structure are provided for releasably coupling a forward end of each shoulder strap to a corresponding waist belt segment.

DESCRIPTION OF THE PREFERRED EMBODIMENTS

The entire disclosure of my aforementioned U.S. Pat. No. 5,620,282 entitled BUOYANCY COMPENSATOR ASSEMBLY granted Apr. 15, 1997 is specifically incorporated herein by reference.

Unless otherwise indicated, the parts of the preferred embodiment of my modular buoyancy control device (BCD) hereafter described are generally made of woven Nylon, polypropylene or other suitable high-strength synthetic fabric.

Figure 1:
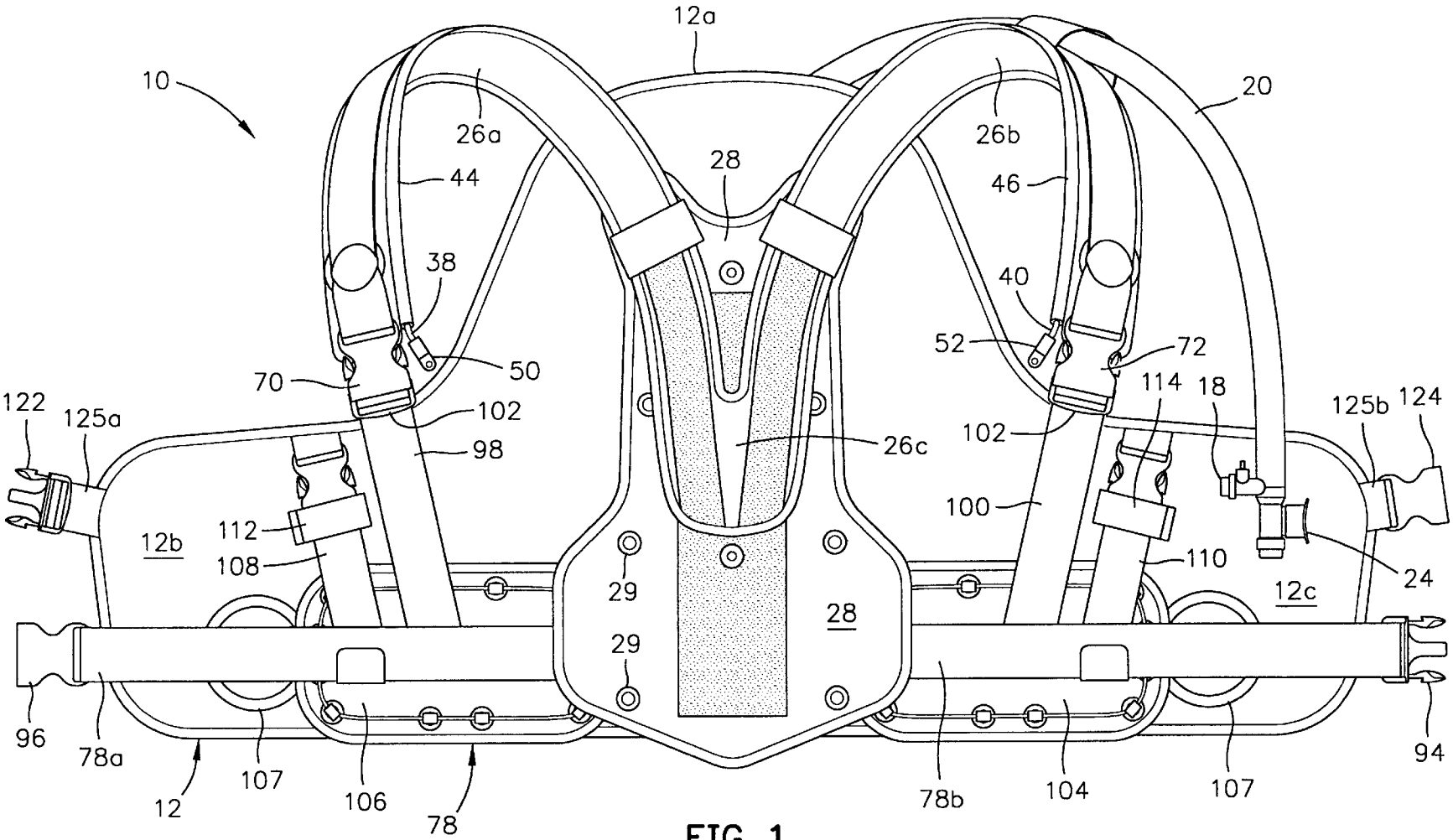
FIG. 1 is a front elevation view of a preferred embodiment of a modular diver's buoyancy control device (BCD) representing a preferred embodiment of my invention. The modular BCD has been illustrated as if it had been laid flat on the ground.
Figure 2:
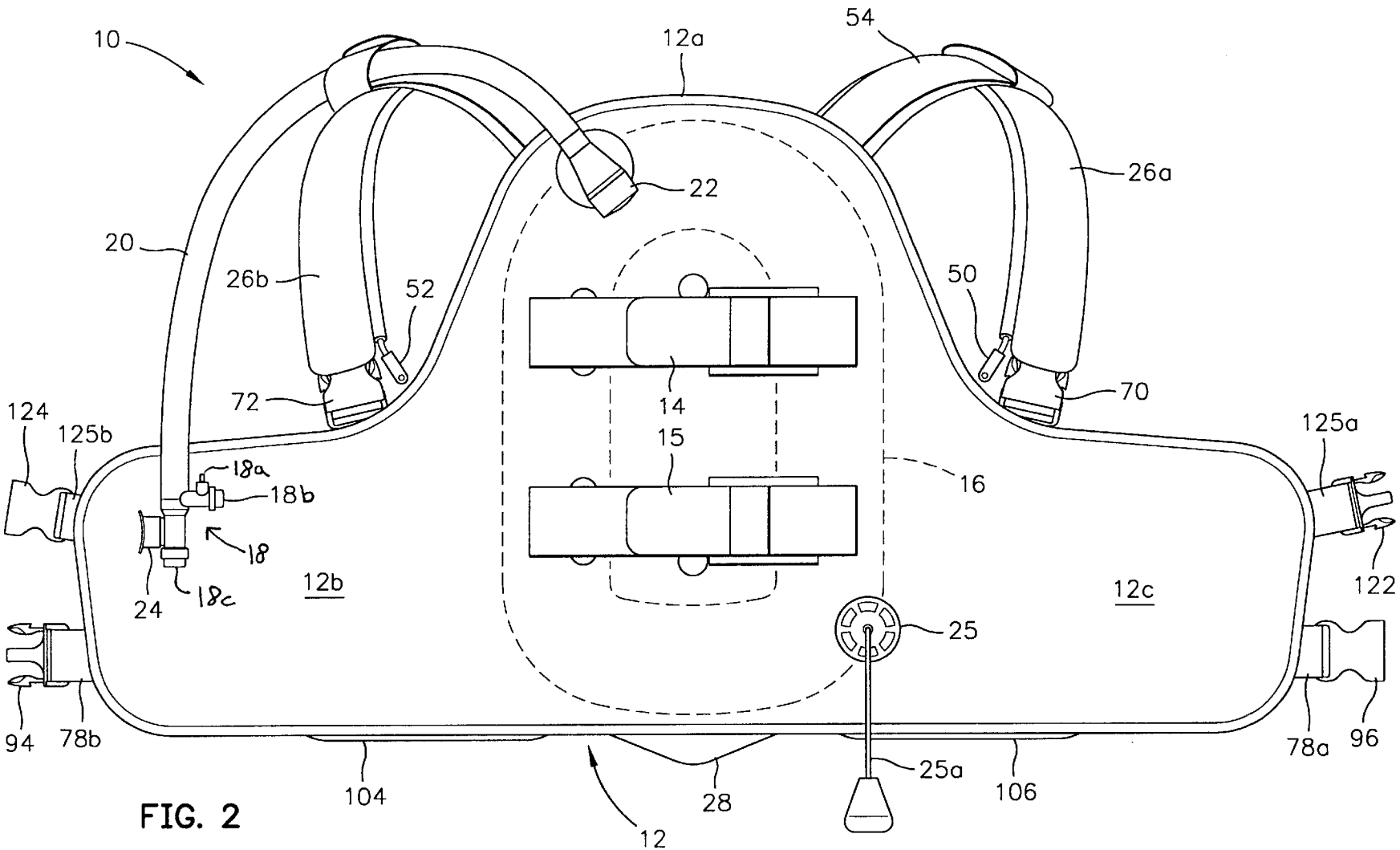
FIG. 2 is a rear elevation view of the modular BCD of FIG. 1. In this figure the BCD has also been illustrated as if it had been laid flat on the ground.

Referring to FIGS. 1 and 2, in accordance with my invention a diver's buoyancy control device (BCD) 10 comprises a vest or jacket 12 configured to be worn by a diver (not illustrated). The jacket 12 includes a back portion 12*a* for overlying a diver's back and a pair of side portions 12*b* and 12*c* connected to the back portion 12*a* for overlying the diver's chest. The term jacket is used loosely to describe any garment, vest, harness or other structure that can be secured over a part of the body for carrying a scuba tank. It need not have the side portions 12*b* and 12*c*. A scuba tank (not illustrated) may be releasably connected to the center of the back portion 12*a* of the jacket 12 via releasable clamp assemblies 14 and 15 (FIG. 2).

An inflatable 0-shaped bladder 16 (FIG. 2) is connected to the inside of the back portion 12*a* of the jacket 12. The bladder 16 may extend into the side portions 12*b* and 12*c* of the jacket 12 through a system of baffles if additional flotation is desired. The bladder 16 typically comprises two layers of polyurethane or other gas impervious material. The layers are juxtaposed between overlying outer fabric layers of the back portion 12*a* of the jacket 12. The layers of the bladder 16 have their peripheral edges welded or otherwise sealed to form an air-tight chamber, as is well known in the art.

A conventional manually actuated control mechanism 18 (FIG. 1) is connected to a hose 20 that connects to a fitting 22 coupled to the bladder 16. Another hose (not illustrated) connects to quick coupling 18*a* on the control mechanism 18 and to a regulator (not illustrated) mounted on the top of the scuba tank. A push button 18*b* on the control mechanism 18 can be manually actuated by the diver's thumb for selectively inflating the bladder 16 with a pressurized gas from the scuba tank. Another push button 18*c* can be manually actuated to vent gas from the bladder 16. A mouth piece 24 connected to the hose 20 can be used by the diver to blow air into the bladder 16 if the scuba tank is empty or the regulator fails by pressing on push button 18*c*. An emergency release valve 25 is mounted to the back portion 12*a* of the jacket 12 and has a cord 25*a* that may be pulled by the diver to vent gas from the bladder 16. This will slow an ascent to the surface that would otherwise be too rapid.

Figure 3:
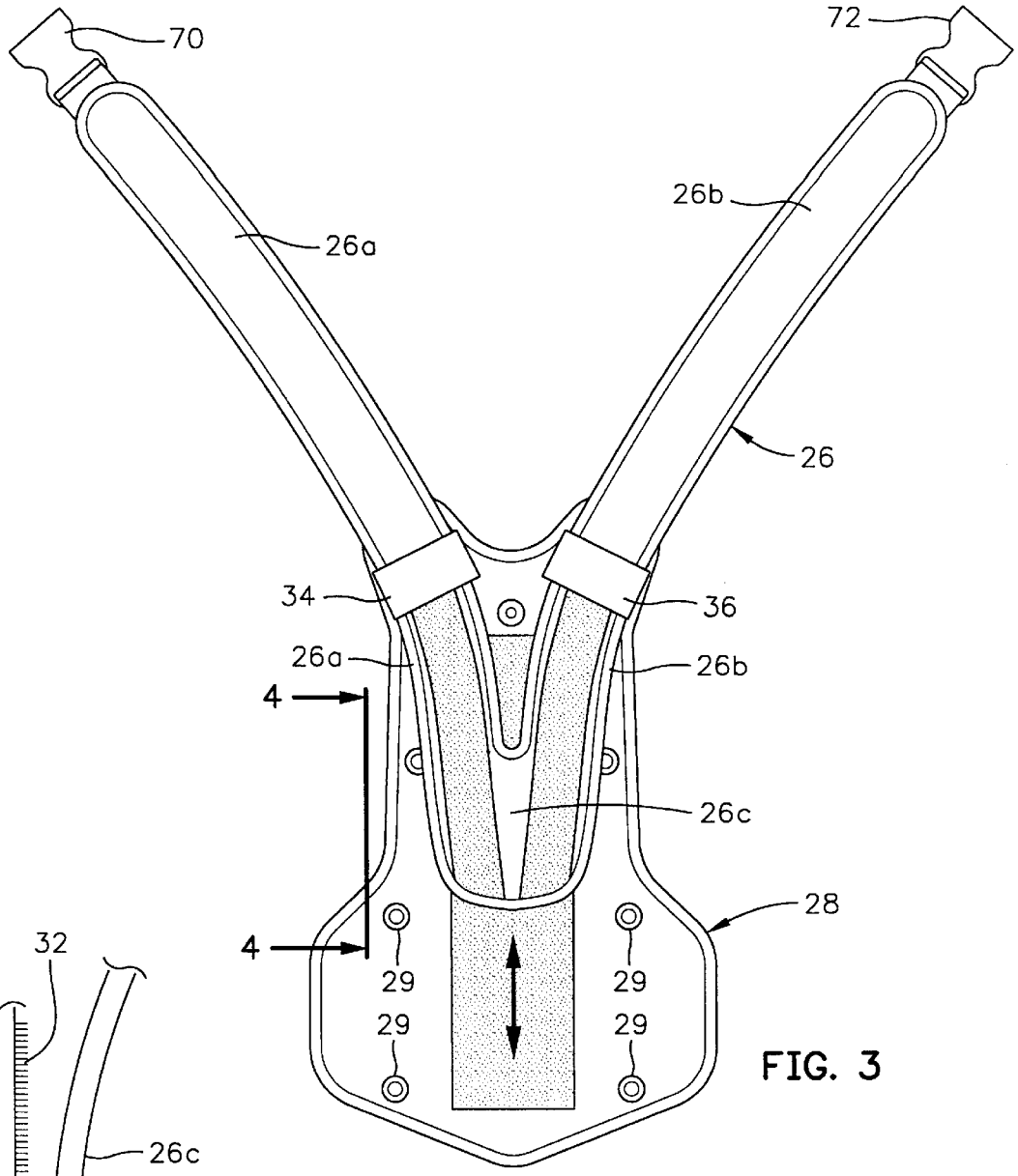
FIG. 3 is an enlarged front elevation view of y-shaped shoulder yoke and back plate of the modular BCD of FIG. 1 that facilitates rapid and easy size adjustment.
Figure 5:
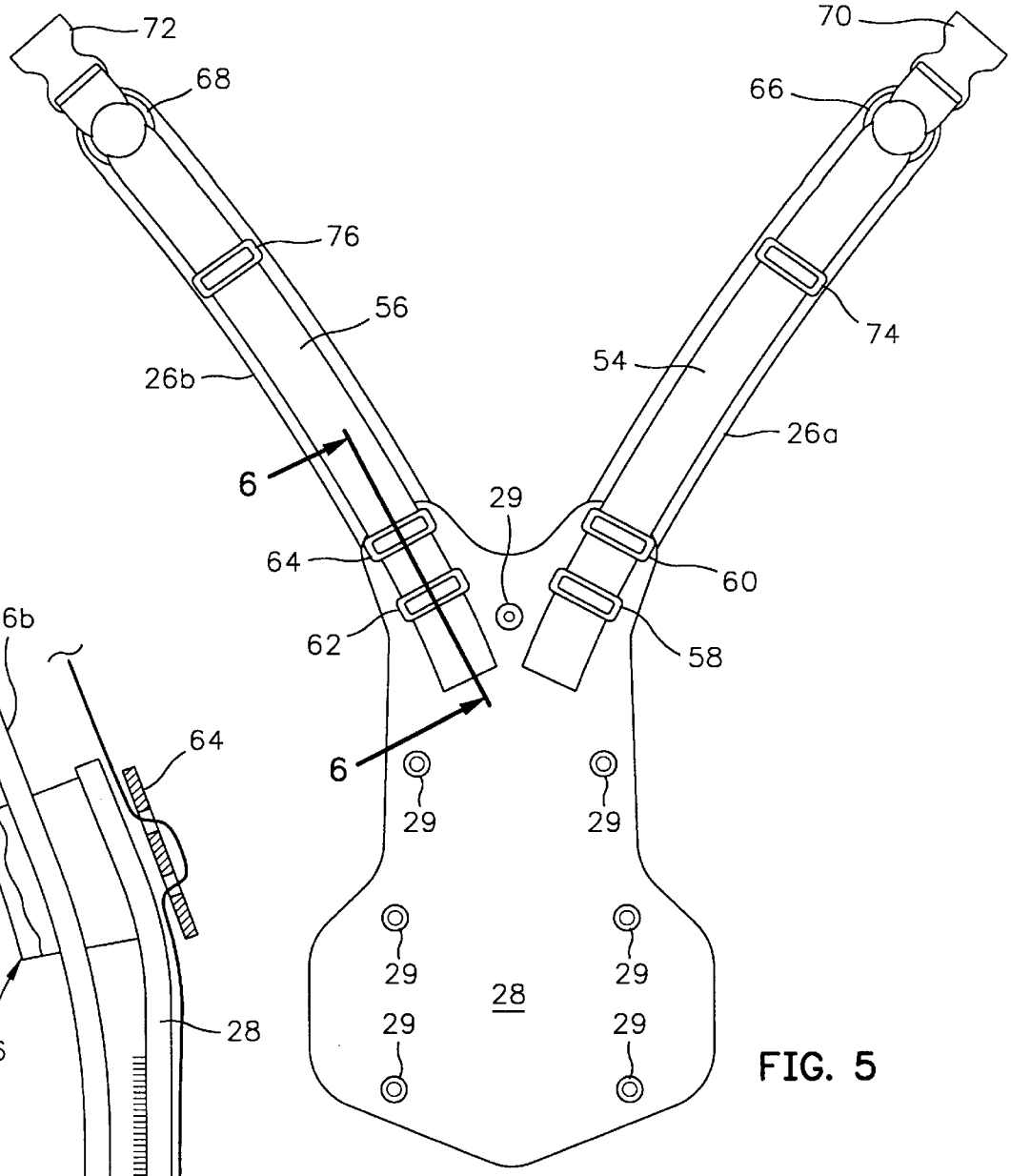
FIG. 5 is an enlarged rear elevation view of the back plate and secondary shoulder straps of the modular BCD of FIG. 1.

The modular BCD 10 is specially constructed to permit rapid and easy size adjustment so that the jacket 12 can fit a wider range of diver statures than conventional BCDs. To this end the BCD 10 includes a Y-shaped shoulder yoke 26 (FIG. 3) that includes a pair of padded shoulder straps 26*a* and 26*b*. The base 26*c* of the y-shaped shoulder yoke 26 is adjustably connected to the back portion 12*a* of the jacket 12 at a plurality of preselected vertical positions thereby effectively changing the length of the shoulder straps 26*a* and 26*b*. The back portion 12*a* of the jacket 12 includes a substantially rigid back plate 28. The back plate 28 preferably incorporates a planar plastic member (not illustrated) encased in a fabric liner and held in position with rivets or eyelets 29 (FIG. 5).

Figure 4:
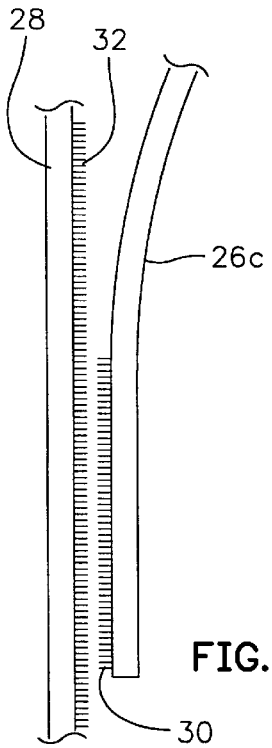
FIG. 4 is an enlarged diagrammatic fragmentary side elevation view taken along line 4—4 of FIG. 3.
Figure 6:
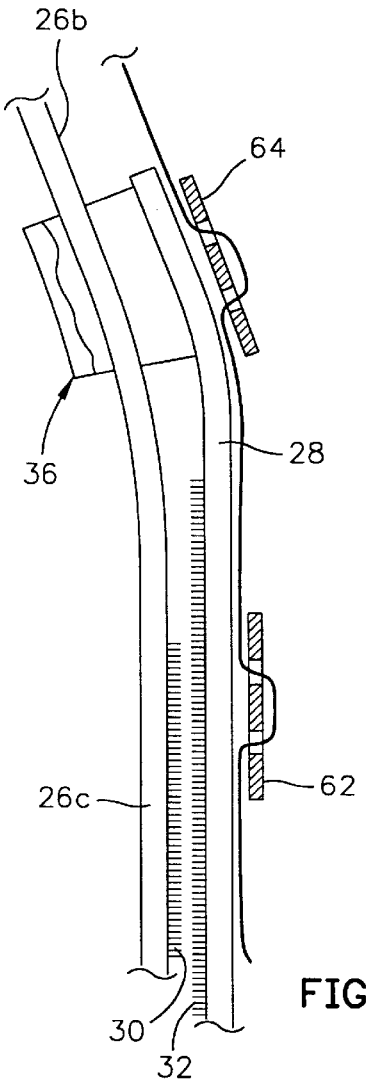
FIG. 6 is an enlarged diagrammatic sectional view taken along line 6—6 of FIG. 5 showing the mating attachment of the base of the y-shaped shoulder yoke to the back plate.

The base 26*c* of the Y-shaped shoulder yoke 26 has a panel 30 (FIG. 4) of a first type of mating hook and weave fabric sewn thereto. A panel 32 of a second type of mating hook and weave fabric is sewn to a forward side of the back plate 28 for releasably anchoring the base 26*c* of the shoulder yoke 26 to the back plate 28 of the jacket 12 at a preselected vertical position. One suitable type of mating hook and weave material is sold under the trademark VELCRO. The manner in which the panels 30 and 32 secure the base 26*c* of the Y-shaped shoulder yoke 26 to the back plate 28 is illustrated in detail in FIG. 6.

A pair of epaulets 34 and 36 (FIG. 3) are sewn to the upper region of the back plate 28 for each receiving and guiding the respective padded shoulder straps 26*a* and 26*b* of the y-shaped shoulder yoke 26. The epaulets 34 and 36 thus control the positions of the padded shoulder straps 26*a* and 26*b*.

Figure 7:
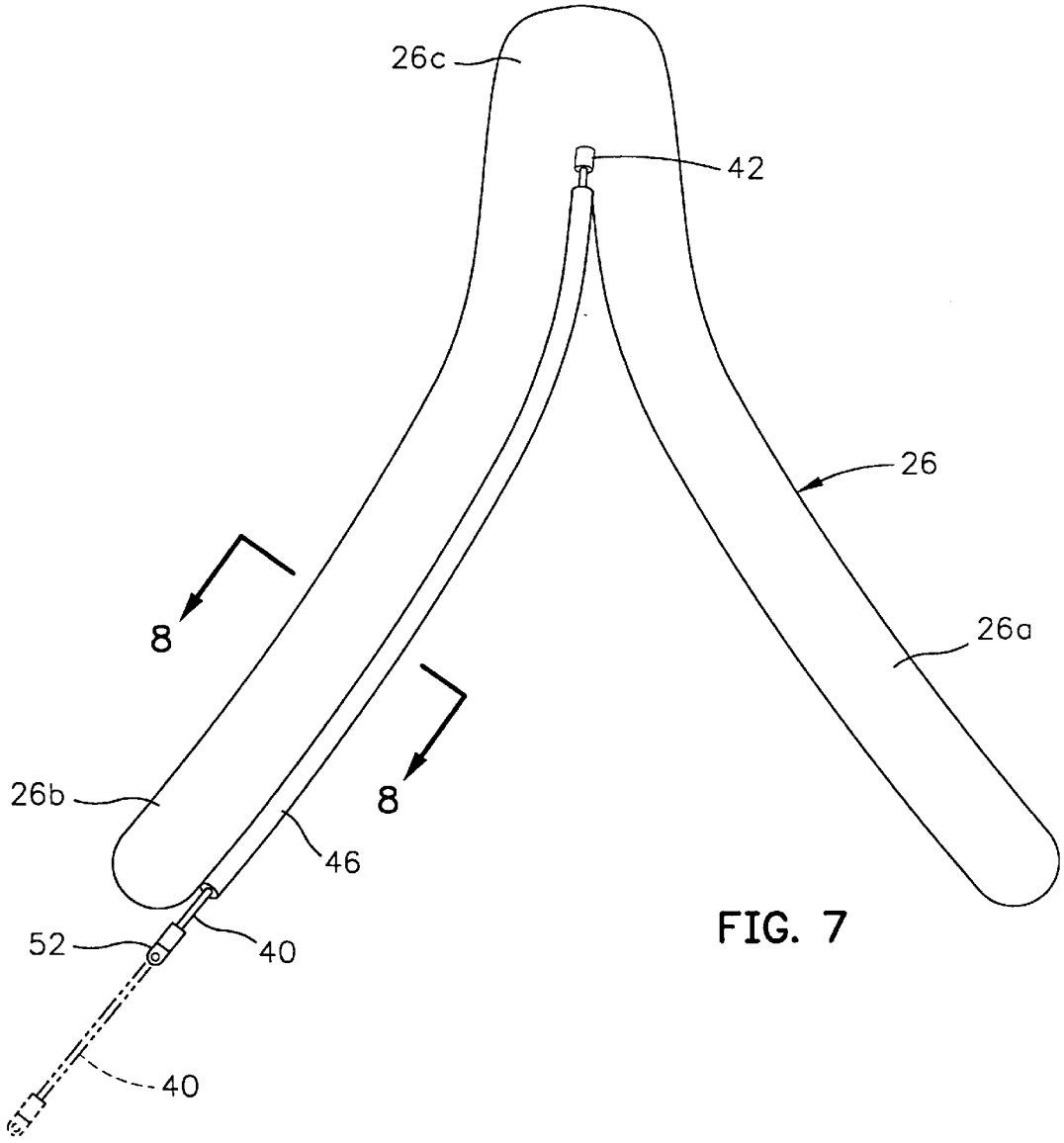
FIG. 7 is an enlarged fragmentary front elevation view of the shoulder yoke of the modular BCD of FIG. 1 illustrating the location of one of the pair of shock cords and its retainer on the edge of one of the shoulder straps.
Figure 8:
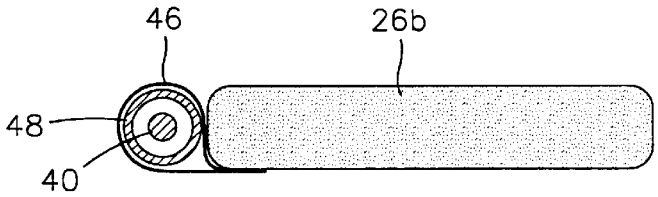
FIG. 8 is a greatly enlarged cross-section view taken along line 8—8 of FIG. 7 illustrating one of the shock cords and its retainer on the edge of one of the shoulder straps of the shoulder yoke.

A pair of elastic shock cords 38 and 40 (FIG. 1) are attached along the lengths of shoulder strap 26*a* and 26*b*, respectively, of the Y-shaped shoulder yoke 26. The rear end of each shock cord such as 40 is secured by an anchor such as 42 (FIG. 7) at the base 26*c* of the shoulder yoke 26. Tube-like fabric covers 44 and 46 (FIGS. 1, 7 an 8) are sewn to the edges of the shoulder straps 26*a* and 26*b*. Each tube-like fabric cover encloses a plastic guide tube such as 48 (FIG. 8) for slidably receiving its corresponding elastic shock cord such as 40 so that it can stretch as shown in phantom lines in FIG. 7. Retaining elements 50 and 52 are connected to the outer ends of shock cords 38 and 40 respectively for connection to a diver's console (not shown) or other items such as the manually actuated inflation control mechanism 18 to prevent them from dangling and becoming tangled. The diver's console is typically an instrument package that includes a pressure gauge, a decompression computer and a compass.

A pair of thin fabric secondary shoulder straps 54 and 56 (FIG. 5) overlap the padded shoulder straps 26*a* and 26*b* of the Y-shaped shoulder yoke 26, respectively. Means in the form of adjustable metal buckles 58, 60, 62 and 64 are provided for connecting the rearward ends of the secondary shoulder straps 54 and 56 to the upper portion of the back plate 28. Means in the form of metal loops 66 and 68 are provided for connecting the forward ends of the secondary shoulder straps 54 and 56 to plastic female shoulder strap buckle elements 70 and 72. The secondary shoulder straps 54 and 56 also have metal buckles 74 and 76 positioned intermediate their lengths. The metal buckles associated with the secondary shoulder straps 54 and 56 allow the lengths of these straps to be adjusted once the position of the y-shaped shoulder yoke 26 has been established. This allows the secondary straps 54 and 56 to carry most of the load on the back portion 12*a* principally attributable to the weight of the scuba tank.

Figure 12:
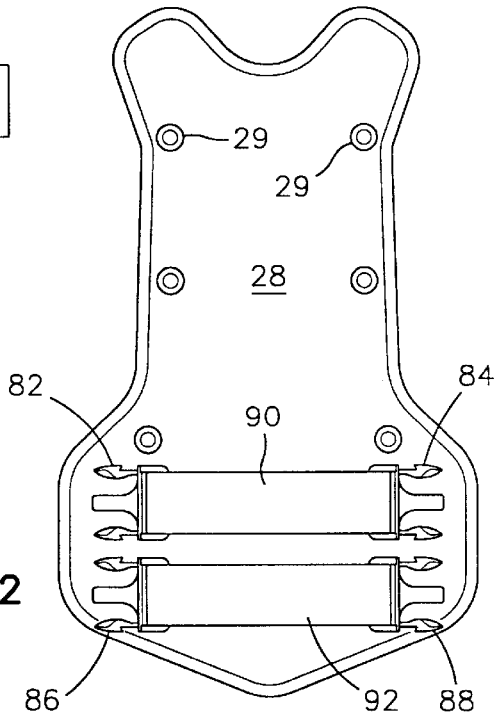
FIG. 12 is a rear elevation view of the back plate of the modular BCD of FIG. 1 showing the buckle arrangement for connecting the waist belt segments at different vertical heights.

A waist belt assembly 78 (FIG. 1) has a pair of waist belt segments 78*a* and 78*b*. Each waist belt segment has a rear end with a female buckle element such as 80 (FIG. 10) that is attached to a corresponding side location on the back panel 28 of the back portion 12*a* of the vest 12. Two pairs of male buckle elements 82, 84, 86 and 88 (FIG. 12) are secured a two different vertical positions on the back plate 28 on opposite sides thereof. The male buckle elements 82 and 84 are connected by a strap segment 90 and the male buckle elements 86 and 88 are connected by a strap segment 92. The straps 90 and 92 are sewn to the outer fabric covering of the back plate 28. The female buckle elements 80 at the rear ends of the waist belt segments 78*a* and 78*b* may be connected to corresponding upper or lower ones of the male buckle elements 82, 84, 86 and 88 to adjust the height of the waist belt assembly 78. This allows further adjustment of the size of the BCD device 10 for comfort. It also allows the diver to adjust his or her trim in the water, i.e. the diver's center of gravity for easier swimming. The forward ends of the waist belt segments 78*a* and 78*b* are provided with mating male and female buckle elements 94 and 96 (FIG. 1) for releasably coupling the waist belt segments together around the diver's waist.

A pair of shoulder strap extensions 98 and 100 (FIG. 1) each have a lower end connected by stitching to a corresponding one of the waist belt segments 78*a* and 78*b*. The upper ends of the shoulder strap extensions 98 and 100 are provided with male buckle elements such as 102 (FIG. 10) for releasably coupling an upper end of each shoulder strap extension to a corresponding padded shoulder strap 26*a* or 26*b* of the y-shaped shoulder yoke 26 via one of the female buckle elements 70 or 72.

The weight belt assembly 78 may be of the type disclosed in my U.S. Pat. No. 5,205,672 entitled DIVER'S WEIGHT ASSEMBLY granted Apr. 27, 1993, the entire disclosure of which is specifically incorporated herein by reference. It includes weight packs 104 and 106 (FIGS. 1 and 14), The waist belt assembly 78 allows the diver to pull on rings 107 to quickly release and jettison the weights in the packs 104 and 106 to enable emergency ascent.

Figure 13:
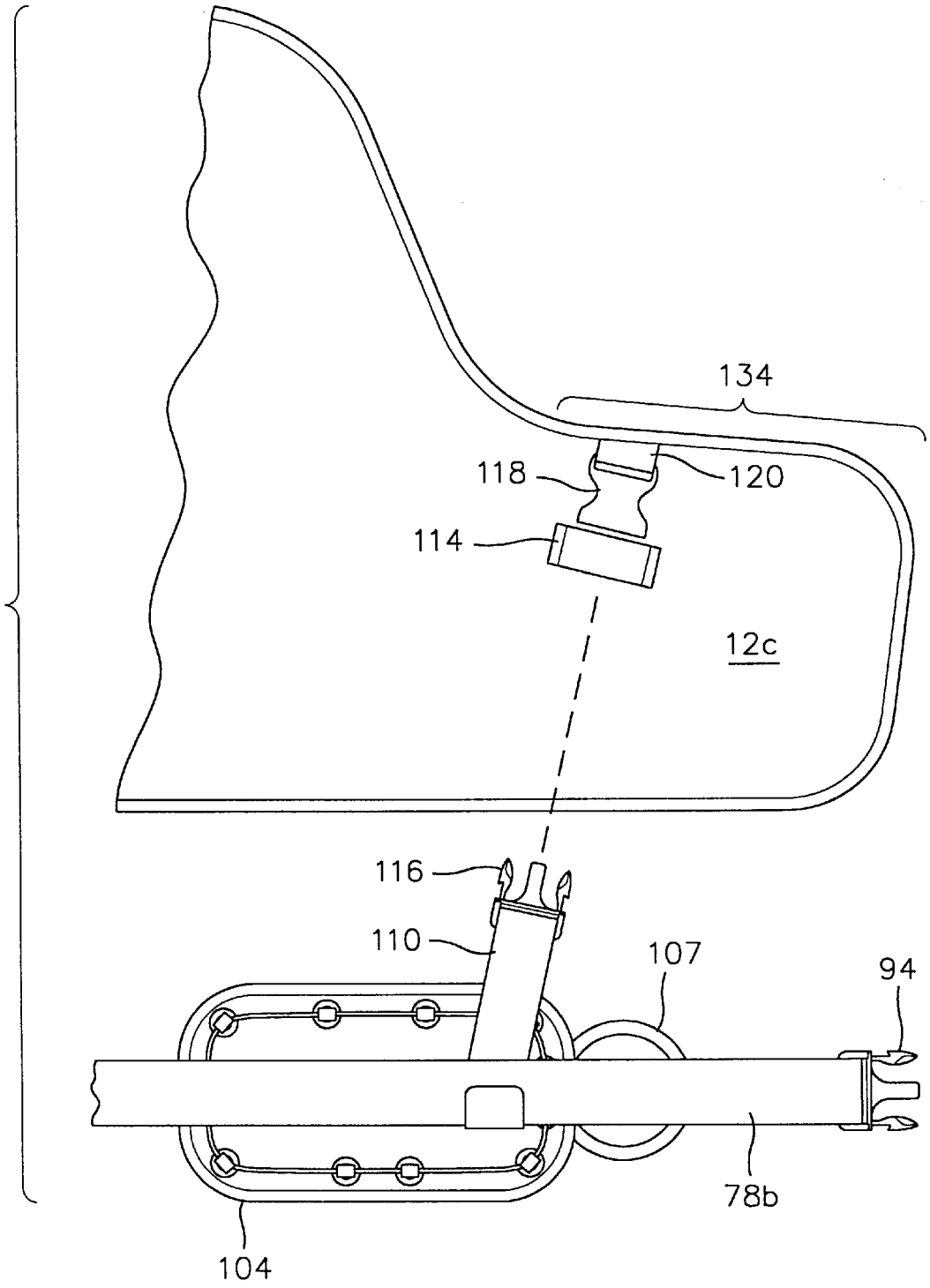
FIG. 13 is a fragmentary front elevation view illustrating the attachment of a quick release weight belt to a wing of the modular BCD of FIG. 1.

The bladder 16 may have extra buoyancy cells (not illustrated) inside each side portion 12*b* and 12*c* for increased surface flotation capability. Stay straps 108 and 110 (FIG. 1) have their lower ends connected to the waist belt segments 78*a* and 78*b*, respectively. The upper ends of the stay straps 108 and 110 pass through loops 112 and 114, respectively, sewn to the jacket side portions 12*b* and 12*c*. The upper end of each stay strap such as 110 has a male buckle element such as 116 (FIG. 13) connected thereto. The male buckle element 116 may be snapped into a mating female buckle element 118 secured via fabric loop 120 to the side portion 12*c* of the jacket 12. The other stay strap 108 is similarly configured and connected to its corresponding side portion 12*b* of the jacket 12. Male and female buckle elements 122 and 124 (FIG. 1) are connected via fabric loops 125*a* and 125*b* to the upper outer edges of the side portions 12*b* and 12*c* of the jacket 12. The buckle elements 122 and 124 can be snapped together to hold the jacket side portions 12*b* and 12*c* in position around the diver's waist. The jacket stay straps 108 and 110 connect the waist belt assembly 78 to the side portions 12*b* and 12*c* of the jacket 12 in order to counter their buoyant force where the bladder 16 is configured with extra buoyancy cells that extend into the side portions 12*b* and 12*c* of the jacket 12. This holds the jacket 12 in place around the diver.

Figure 9:
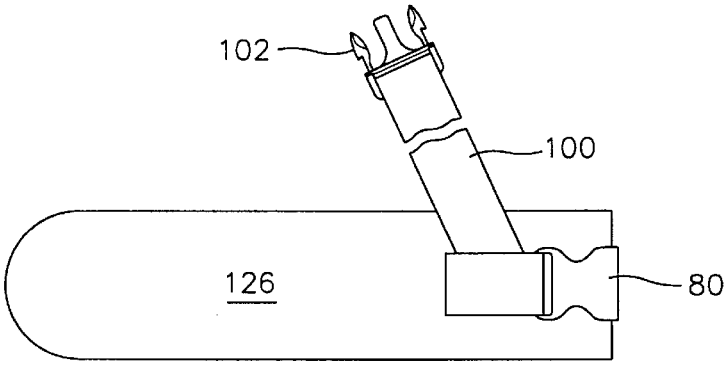
FIGS. 9–11 are reduced simplified plan views of various alternate waist belt assemblies that may be utilized with the modular BCD of FIG. 1.
Figure 10:
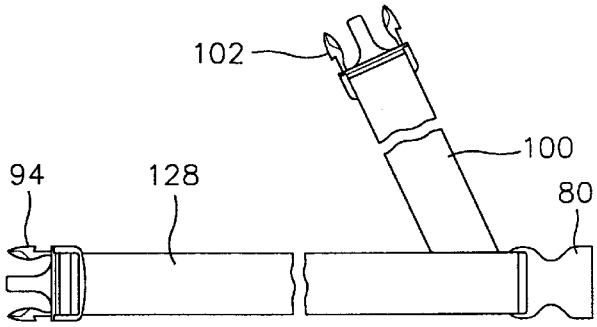
Figure 11:
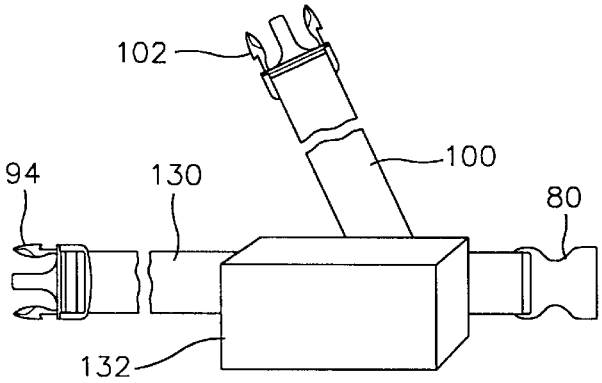

FIGS. 9–11 are reduced simplified plan views of various alternate waist belt assemblies that may be utilized with the modular BCD of FIG. 1. FIG. 9 illustrates a wide comfort band waist belt segment 126. The forward rounded end of the segment 126 may be provided with one type of hook and weave material to mate with the other type of hook and weave material on the rounded end of the other similarly configured wide comfort band waist belt segment. Again the female buckle elements 80 on the rear end of each band 126 snap over selected ones of the male buckle elements 82, 84, 86 or 88 connected to the rear side of the back plate 28. This wide comfort waist belt alternative is useful in warm water diving where a wet or dry suit is not needed and thus a weight belt is not required.

FIG. 10 illustrates another waist belt segment 128 similar to the waist belt of the embodiment of FIG. 1 except that the former has no weights and is again designed for warm water diving. FIG. 11 illustrates yet another waist belt segment 130 similar to the waist belt of FIG. 10 except that the former has a box 132 secured thereto for carrying a selected size and number of dive weights. The box 132 could also serve as a utility pocket.

Figure 14:
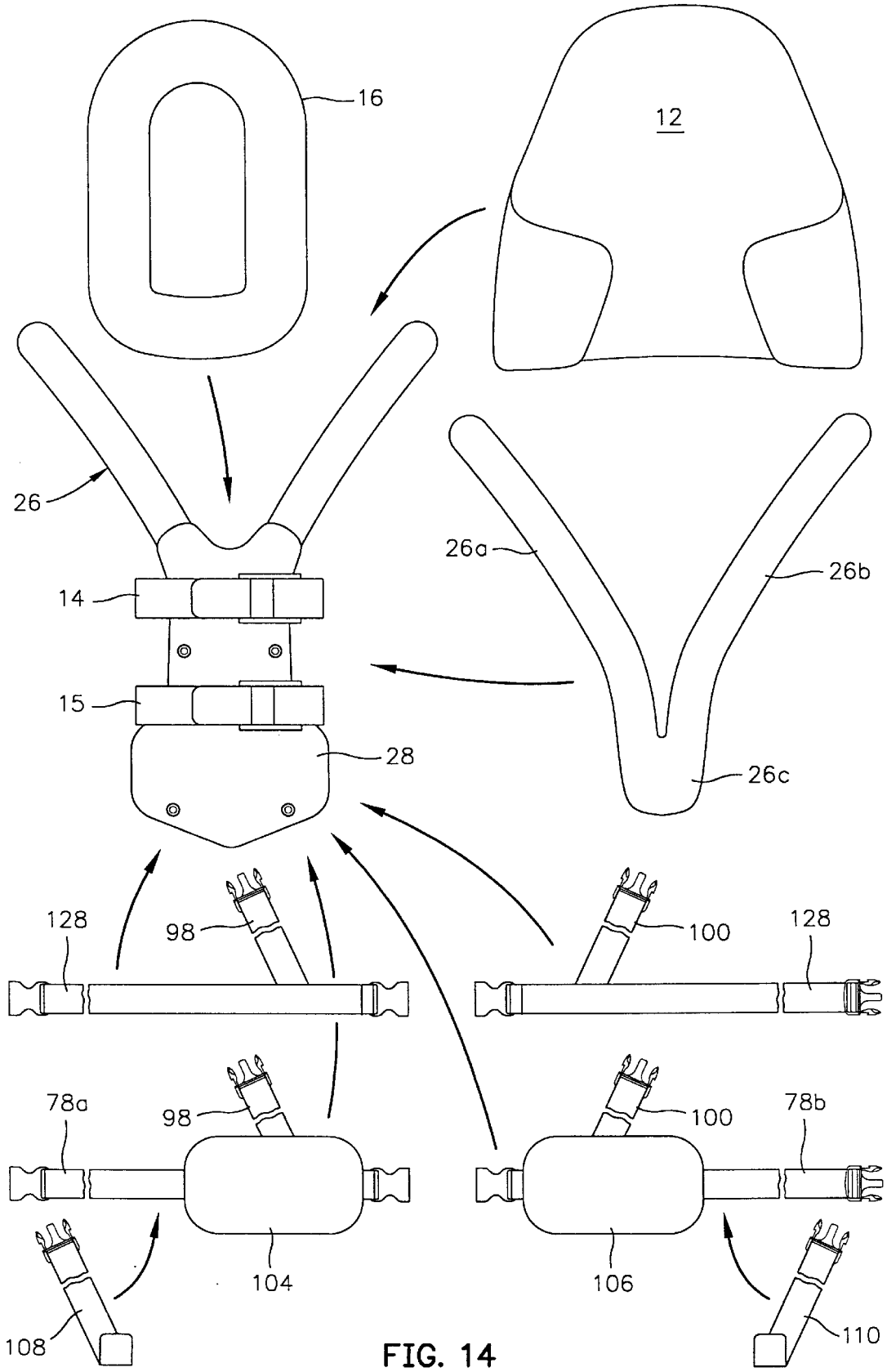
FIG. 14 is a simplified reduced diagrammatic view illustrating various alternate configurations and components of the modular BCD of the present invention.

FIG. 14 is a simplified reduced diagrammatic view illustrating various alternate configurations and components of the BCD 10 of the present invention. This view emphasizes its modular construction which allows the BCD 10 to be readily adjusted in size and readily configured with different waist belt options depending upon the stature of the diver and the requirements of the dive.

While I have describe a preferred embodiment of my modular BCD in detail, and various configurations thereof, it will be understood that my invention can be further modified in both arrangement and detail. For example, the extended regions or outer wings (designated with the reference numeral 134 in FIG. 13) of the side portions 12*b* and 12*c* of the jacket could be eliminated. In such a case, it would no longer necessary to utilize the stay straps 108 and 110. Therefore, the protection afforded by invention should only be limited in accordance with the following claims.

I claim:

1. A diver's buoyancy control device, comprising:

a jacket configured to be worn by a diver;

means for releasably connecting a scuba tank to a back portion of the jacket;

an inflatable bladder connected to the back portion of the jacket;

means for selectively inflating and deflating the bladder with a pressurized gas from the scuba tank;

a pair of shoulder straps;

means for adjustably connecting a pair of rearward ends of the shoulder straps to the back portion of the jacket at a plurality of preselected vertical positions;

a waist belt having a pair of segments each having a rear end attached to a corresponding location on the back portion of the jacket;

means for releasably coupling a pair of mating forward ends of the waist belt segments;

means for releasably coupling a forward end of each shoulder strap to a corresponding waist belt segment; and a pair of secondary shoulder straps overlapping the shoulder straps, means for connecting a pair of rearward ends of the secondary straps to the back portion of the jacket, and means for connecting a pair of forward ends of the secondary straps to corresponding ones of the waist belt segments for carrying a load on the back portion of the jacket.

2. The buoyancy control device of claim 1 wherein the jacket includes a pair of side portions for overlying a chest of the diver.

3. The buoyancy control device of claim 2 wherein each side portion of the jacket includes an outer wing, and each waist belt segment has a weight pack and a stay strap secured at a lower end thereof to the waist belt segment, each wing has a loop secured thereto for receiving a corresponding stay strap, and means are provided for releasably coupling an upper end of each stay strap to a corresponding wing.

4. The buoyancy control device of claim 1 wherein the shoulder straps are connected at their rearward ends to form a yoke and the means for adjustably connecting the rearward ends of the shoulder straps to the back portion of the jacket at a plurality of preselected vertical positions includes a pair of mating hook and weave material panels connected to the yoke and the back portion of the jacket.

5. The buoyancy control device of claim 1 wherein the means for releasably coupling a forward end of each shoulder strap to a corresponding waist belt segment includes a shoulder strap extension.

6. The buoyancy control device of claim 1 wherein the back portion of the jacket includes a back plate and the shoulder straps are connected together at their rearward ends to form a generally Y-shaped shoulder yoke having a base that is slidable vertically along the back plate.

7. The buoyancy control device of claim 6 and further comprising a pair of epaulets connected to the back plate for each receiving and guiding a corresponding shoulder strap of the yoke.

8. The buoyancy control device of claim 6 wherein the rear end of each waist belt segment has a first buckle element attached thereto and the buoyancy control device further comprises two pairs of second buckle elements configured to mate with the first buckle elements, the second buckle elements being secured a two different vertical positions on the back plate on opposite sides thereof.

9. The buoyancy control device of claim 1 and further comprising at least one elastic shock cord, and means for attaching the shock cord along a length of a corresponding shoulder strap.

10. A diver's buoyancy control device, comprising:

a jacket configured to be worn by a diver including a back portion for overlying a diver's back;

means for releasably connecting a scuba tank to the back portion of the jacket;

an inflatable bladder connected to the back portion of the jacket;

means for selectively inflating and deflating the bladder with a pressurized gas from the scuba tank;

a shoulder yoke including a pair of shoulder straps connected at a base of the yoke;

means for adjustably connecting the base of the shoulder yoke to the back portion of the jacket at a plurality of preselected vertical positions;

a waist belt having a pair of segments each having a rear end attached to a corresponding location on the back portion of the jacket;

first means for releasably coupling a pair of mating forward ends of the waist belt segments;

a pair of shoulder strap extensions each having a lower end connected to a corresponding waist belt segment;

second means for releasably coupling an upper end of each shoulder strap extension to a corresponding shoulder strap of the yoke; and a pair of secondary shoulder straps overlapping the shoulder straps of the yoke, means for connecting a pair of rearward ends of the secondary straps to the back portion of the jacket, and means for connecting a pair of forward ends of the secondary straps to the second coupling means for carrying a load on the back portion of the jacket.

11. The buoyancy control device of claim 10 wherein the jacket includes a pair of side portions for overlying a chest of the diver.

12. The buoyancy control device of claim 11 wherein each side portion of the jacket includes an outer wing, and each waist belt segment has a weight pack and a stay strap secured at a lower end thereof to the waist belt segment, each wing has a loop secured thereto for receiving a corresponding stay strap, and means are provided for releasably coupling an upper end of each stay strap to a corresponding wing.

13. The buoyancy control device of claim 11 wherein the waist belt has plurality of weights and means for quickly releasing the weights so that the diver can rapidly ascends.

14. The buoyancy control device of claim 11 wherein the means for adjustably connecting the base of the shoulder yoke to the back portion of the jacket at a plurality of preselected vertical positions includes mating sections of hook and weave material.

15. The buoyancy control device of claim 11 wherein the back portion of the jacket includes a back plate and the base of the shoulder yoke is slidable along the back plate.

16. The buoyancy control device of claim 15 and further comprising a pair of epaulets connected to the back plate for each receiving and guiding a corresponding shoulder strap of the yoke.

17. The buoyancy control device of claim 15 wherein the rear end of each waist belt segment has a first buckle element attached thereto and the buoyancy control device further comprises two pairs of second buckle elements configured to mate with the first buckle elements, the second buckle elements being secured a two different vertical positions on the back plate on opposite sides thereof.

18. The buoyancy control device of claim 10 and further comprising at least one elastic shock cord, and means for attaching the shock cord along a length of a corresponding shoulder strap of the yoke.

19. A diver's buoyancy control device, comprising:

a jacket configured to be worn by a diver;

means for releasably connecting a scuba tank to a back portion of the jacket;

an inflatable bladder connected to the back portion of the jacket;

means for selectively inflating and deflating the bladder with a pressurized gas from the scuba tank;

a pair of shoulder straps;

means for adjustably connecting a pair of rearward ends of the shoulder straps to a back plate of the back portion of the jacket, the rearward ends of the shoulder straps being connected to form a generally Y-shaped yoke having a base that is slidable vertically along the back plate to a plurality of preselected vertical positions;

a waist belt having a pair of segments each having a rear end attached to a corresponding location on the back portion of the jacket;

means for releasably coupling a pair of mating forward ends of the waist belt segments;

means for releasably coupling a forward end of each shoulder strap to a corresponding waist belt segment; and a pair of epaulets connected to the back plate for each receiving and guiding a corresponding shoulder strap of the yoke.

20. A diver's buoyancy control device, comprising:

a jacket configured to be worn by a diver including a pair of side portions for overlying a chest of the diver;

means for releasably connecting a scuba tank to a back portion of the jacket;

an inflatable bladder connected to the back portion of the jacket;

means for selectively inflating and deflating the bladder with a pressurized gas from the scuba tank;

a pair of shoulder straps;

means for adjustably connecting a pair of rearward ends of the shoulder straps to the back portion of the jacket at a plurality of preselected vertical positions;

a waist belt having a pair of segments each having a rear end attached to a corresponding location on the back portion of the jacket;

means for releasably coupling a pair of mating forward ends of the waist belt segments;

means for releasably coupling a forward end of each shoulder strap to a corresponding waist belt segment; and wherein each side portion of the jacket includes an outer wing, and each waist belt segment has a stay strap secured at a lower end thereof to the waist belt segment, each wing has a loop secured thereto for receiving a corresponding stay strap, and means are provided for releasably coupling an upper end of each stay strap to a corresponding wing.

21. A diver's buoyancy control device, comprising:

a jacket configured to be worn by a diver;

means for releasably connecting a scuba tank to a back portion of the jacket;

an inflatable bladder connected to the back portion of the jacket;

means for selectively inflating and deflating the bladder with a pressurized gas from the scuba tank;

a pair of shoulder straps;

means for adjustably connecting a pair of rearward ends of the shoulder straps to the back portion of the jacket at a plurality of preselected vertical positions to permit rapid and easy size adjustment so that the jacket can fit a wide range of diver statures;

a waist belt having a pair of segments each having a rear end attached to a corresponding location on the back portion of the jacket;

means for releasably coupling a pair of mating forward ends of the waist belt segments;

means for releasably coupling a forward end of each shoulder strap to a corresponding waist belt segment; and wherein the shoulder straps are connected at their rearward ends to form a yoke and the means for adjustably connecting the rearward ends of the shoulder straps to the back portion of the jacket at a plurality of preselected vertical positions includes a pair of mating hook and weave material panels connected to the yoke and the back portion of the jacket, the panel that is connected to the back portion of the jacket being elongated and extending along a majority of a vertical length of the back portion of the jacket.

* * * * *